US005660235A

United States Patent [19]

Sola

[11] Patent Number: 5,660,235

[45] Date of Patent: Aug. 26, 1997

[54] METHOD AND A DEVICE FOR USE IN COIL PIPE OPERATIONS

[75] Inventor: Kjell Inge Sola, Tananger, Norway

[73] Assignee: Transocean Petroleum Technology AS, Norway

[21] Appl. No.: 566,961

[22] Filed: Dec. 4, 1995

[30] Foreign Application Priority Data

Sep. 12, 1995 [NO] Norway ..... 953587

[51] Int. Cl.[6] ..... E21B 19/22

[52] U.S. Cl. ..... 166/384; 166/77.2; 166/85.5; 166/385

[58] Field of Search ..... 166/77.2, 77.3, 166/384, 385, 85.5; 242/399.1, 399.2, 559.1, 564.3

[56] References Cited

U.S. PATENT DOCUMENTS

| | | | |
|---|---|---|---|
| 2,567,009 | 9/1951 | Calhoun et al. | 166/77.3 |
| 3,559,905 | 2/1971 | Palynchuk | 242/564.3 X |
| 4,024,913 | 5/1977 | Grable | 166/77.2 X |
| 4,168,747 | 9/1979 | Youmans | 166/384 X |
| 4,274,799 | 6/1981 | Tisdale, III et al. | 242/399.2 X |
| 4,442,903 | 4/1984 | Schutt et al. | 166/385 |
| 4,523,644 | 6/1985 | Dismukes | 166/77.2 |

FOREIGN PATENT DOCUMENTS

| | | | |
|---|---|---|---|
| 890228 | 1/1972 | Canada | 166/77 |
| 953644 | 8/1974 | Canada | 166/77 |

*Primary Examiner*—Hoang C. Dang
*Attorney, Agent, or Firm*—Andrus, Sceales, Starke & Sawall

[57] ABSTRACT

The invention relates to a method and a device for use in coil pipe operations. A coil pipe (12) is coiled up on a rotary drum (10) and is fed out/in in relation to the drum (10) by means of a feeding device (14) having a rectilinear, through-going passage for the coil pipe (12). In order to reduce the number of straightenings/bendings of the coil pipe (12) to a minimum, the drum (10) is disposed in the immediate association with the feeding device (14), said drum (10) and said feeding device (14) being positioned and orientated such in relation to each other that an imaginary extension of the feeding device's coil pipe passage (16) extends substantially tangentially to the outer circumference of the coil pipe coil on the drum (10). This measure reduces the number of straightening/bending strains to one straightening upon the coil pipe's uncoiling and one bending upon the coil pipe's (12) coiling up on the drum. The drum (10) may be swingable about a horizontal axis (36), in order to compensate for varying coil pipe coil diameter during uncoiling/coiling, so that the tangential directional course of said passage (16) is maintained during the entire uncoiling/coiling operation.

5 Claims, 4 Drawing Sheets

METHOD AND A DEVICE FOR USE IN COIL PIPE OPERATIONS

BACKGROUND OF THE INVENTION

The invention relates to a method for use in coil pipe operations and a device for carrying out the method, wherein a coil pipe is coiled up on a rotatable drum and is coiled off and up thereon by means of a feeding device adapted to feed the coil pipe off and onto the drum, well known under the term "injector", which is placed downstream in relation to the coil pipe drum, and which has a centric coil pipe passage defined between two opposing movable drive means exhibiting reversible directions of motion, and which attacks from either side on the coil pipe and, thus, displaces it in a direction towards the drum or away therefrom.

Coil pipes of this kind are subjected to several strains in the form of bending and straightening movements at each coil pipe operation or run. Upon uncoiling, a straightening movement of the coil pipe from the curved course thereof on the drum takes place at first, whereafter follows a bending of the coil pipe across a curved face, the so called "swan neck". Also the coil pipe is subjected to the same straightening and bending movements when it is in the course of being coiled up on the drum.

As distinct from a conventional drill string, a coil pipe is without joints and is very advantageous in this respect, but said bending and straightening movements lead to metal fatigue, and the coil pipe must be replaced after a certain number of runs or trips down into the well.

On floating platforms, the injector and the swan neck are heave compensated. Seaway causes the coil pipe to slide across the swan neck constantly, thus being bent/straightened out.

The drum is adapted to take up and give out slack in step with the heave compensation, and the coil pipe is, therefore, subjected to many bendings and straightenings due to seaway, reducing the working life of the coil pipe substantially.

A coiled up coil pipe to be passed downwards into the well undergoes three fatigue strains:

—the coil pipe is straightened out when leaving the drum and further on its way towards the swan neck, —the coil pipe is then curved over the swan neck, and —the coil pipe is straightened out on its way out from the swan neck, heading for the injector.

A straightened coil pipe within a well also undergoes three fatigue movements before it is back on the drum:

—the coil pipe is first curved over the swan neck,

—the coil pipe is straightened on its way out from the swan neck, heading for the drum, and —the coil pipe is curved upon being coiled up on the drum.

Thus, a coil pipe which is passed down into the well is totally subjected to at least six fatigue movements before it is back on the drum again. Fatigue movements due to heave compensation of the swan neck should, possibly, be added thereto.

In this connection, it should be mentioned that the method and the device according to the present invention are equally well suited for use in drilling for oil and gas as well as related coil pipe operations both on land and offshore.

Another disadvantage of coil pipe drums and the suspension thereof as well as their positioning consists in that complete drums are expensive, the building up being in part constructively complex, which i.a. is due to the existence of a spooling device for the coil pipe, said spooling device being movable to and fro parallel to drum axis, distributing the coil pipe windings evenly across the length of the hollow core of the drum during coiling operations.

A further disadvantage of known coil pipes undergoing coiling up and uncoiling operations with respect to a rotatable drum is that the course taken by the coil pipe and strains acting thereon may give rise to residual bends in the coil pipe subsequent to straightening. Thus, the coil pipe is not straightened out properly, and it will take a spiral-shaped course within the well. This gives increased friction against the well wall.

There does not exist a known technique to reduce the number of bendings and following straightenings of coil pipes during uncoiling and coiling.

SUMMARY OF THE INVENTION

It has been a primary object of the present invention to provide a method and a device wherein the number of bendings/straightenings to which the coil pipe is subjected per run, may be reduced essentially. Likewise, one aims at reducing costs associated with guided coiling, distributing coil pipe windings evenly accross the length of the drum core. Also, one aimed at avoiding fatigue strains acting on coil pipes due to vertical movements on board floating platforms.

According to the invention, these objects are realized by proceeding in accordance with the method and device as set forth in the claims.

To reduce the number of bending/straightening strains on the coil pipe, the rotatable drum thereof is suspended and positioned such in relation to the underlying feeding device providing the pulling out and pushing in of the coil pipe in relation to the rotatable drum, that an imaginary extension of the substantially rectilinear (vertical) coil pipe passage of the feeding device is tangent to the pipe coil on the drum. Thus, the coil pipe is coiled directly to said feeding device on its way out, and directly from the latter to the drum on the coil pipe's way in, reducing the number of bending/straightening strains to one straightening upon uncoiling of the coil pipe from the drum and one bending upon hauling the coil pipe in and coiling it up on the drum.

In lieu of using a known coiling device mounted on a special drum and adapted to guide the coil pipe to and fro across the rotary drum core during coiling up, distributing the coil pipe evenly on said drum core, the present invention uses a displaceable drum, e.g. a cheap drum of the kind on which coil pipe is delivered from the manufacturer, in coiled up condition. More specifically, the coil pipe drum is placed on a movable undercarriage adapted to displace iself to and fro in the direction of the rotational axis of the drum, creating the same effect as caused by said known coiling mechanism.

In order that the vertical passage of the feeding device ("injector") at all times shall extend such as to be a tangent to the pipe coil on the drum, taking into consideration that the diameter of the pipe coil decreases as coil pipe is being uncoiled, an undercarriage for the coil pipe drum is turnable about a lower, horizontal axis, the undercarriage together with the drum rotates and the originally horizontal base plate thereof forms a constantly larger acute angle with a horizontal plane as the pipe coil's diameter decreases. By this is achieved that the pipe coil in a simple way is positioned such in relation to the passage of the feeding device that said passage substantially is a tangent to the pipe coil, irrespective of the diameter of the pipe coil. The passage can be aligned with the bore hole, and the drum is rotated inwardly towards the bore hole as coil pipe is being uncoiled and the diameter of the pipe coil diminishes. Thereafter, in drilling operations on shore, the outer free end of the coil pipe is connected to a blow-out preventer brought into position. Used onboard floating installations, the drum is suspended from a drawwork and a heave compensator is assigned thereto.

In accordance with an embodiment of the device according to the invention, the coil pipe drum and the feeding device are carried by a common rack, the coil pipe passage of the feeding device being directed to be a tangent to the full circumference of the pipe coil on the drum which, in its turn, is adapted to be swung about a horizontal axis in relation to said feeding device. However, in principle, there is nothing to prevent the drum from being suspended from its own rack, said feeding device being disposed such as is known in connection with conventional technique.

As indicated in the foregoing, the displacement of the drum and the drum undercarriage to and fro in the direction of the rotational axis of the drum will make superfluous the use of partly complex and expensive coiling devices as delivered on special drums mounted thereto. Thus, according to the invention, one does not need an advanced drum structure, and the drums on which coil pipe is delivered coiled up on, are excellently fitted for the purpose, resulting in substantial savings.

BRIEF DESCRIPTION OF THE DRAWINGS

The invention is further explained in the following in association with an example of a possible embodiment and with reference to the attached drawings, wherein:

FIG. 3 shows a situation where nearly all coil pipe coiled up on the drum has been uncoiled therefrom;

FIG. 4 and 5 shows top plan views, corresponding to the preceding figures, and illustrate a displaceable suspension of the drum to and fro in the direction of the rotational axis of the drum, resulting in an even distribution of coil pipe windings across the length of the core of the drum, figure showing 4 a carriage/slide for the drum in one end position on a guide rail or similar guidance/support, while FIG. 5 shows the same carriage/slide in the other end position on the guide rail.

DETAILED DESCRIPTION OF THE PREFERRED EMBODIMENT

Figure 1:
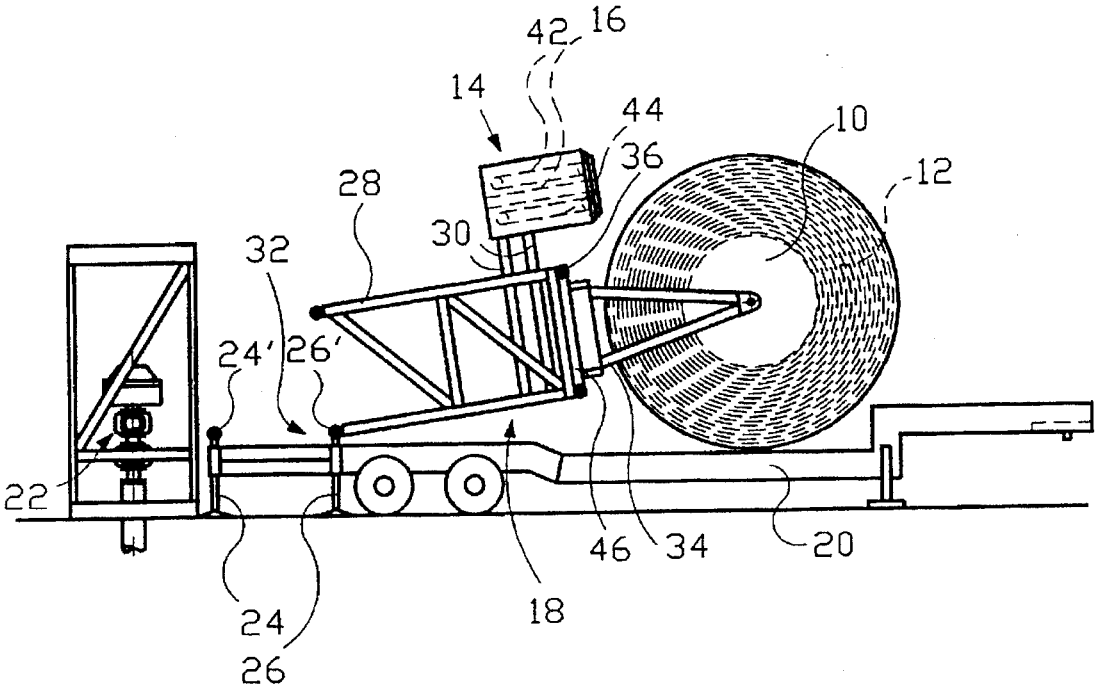
FIG. 1 shows a side elevational view of a coil pipe drum disposed on a common rack for the drum and a feeding device for the coil pipe, the rack being carried by a mobile undercarriage, a blowout preventer being installed (land based installation as opposed to offshore installation), and said rack and, thus, the coil pipe drum as well as the feeding device occupy a position of readiness in relation to the blowout preventer, the one lower end of the rack being connected to a stationary pivot having a horizontal axis.

Reference is first made to FIG. 1 showing a coil pipe drum 10 having a coil pipe 12 coiled up thereon, and a feeding device 14 having a through-going passage 16 for the coil pipe 12, drum 10 and device 14, according to this embodiment, being mounted on a common rack 18 which, together with drum 10 and feeding device 14, is carried by a trailer 20.

The application case indicated in the exemplary embodiment is associated with coil pipe operations on shore, and a blowout preventer 22 has been brought into position and is installed.

The trailer 20 carries upright supports 24 and 26 which are spaced from the blowout preventer 22.

The supports 24 and 26 constitute the lowermost parts of the rack 18, and the upper ends 24' and 26' thereof may establish pivots with the lower end of an intermediate rack part 28, which is rigidly connected to a rack part 30 carrying the feeding device 14.

In accordance with FIG. 1, the intermediate rack part 28 is pivotally connected at its lower end to the upper end of the support 26. The meeting ends form a joint 32 having a horizontal rotary axis.

Uppermost, the intermediate rack part 28 is pivotally connected to an upper rack part 34 about a joint 36 having a horizontal rotary axis.

Figure 2:
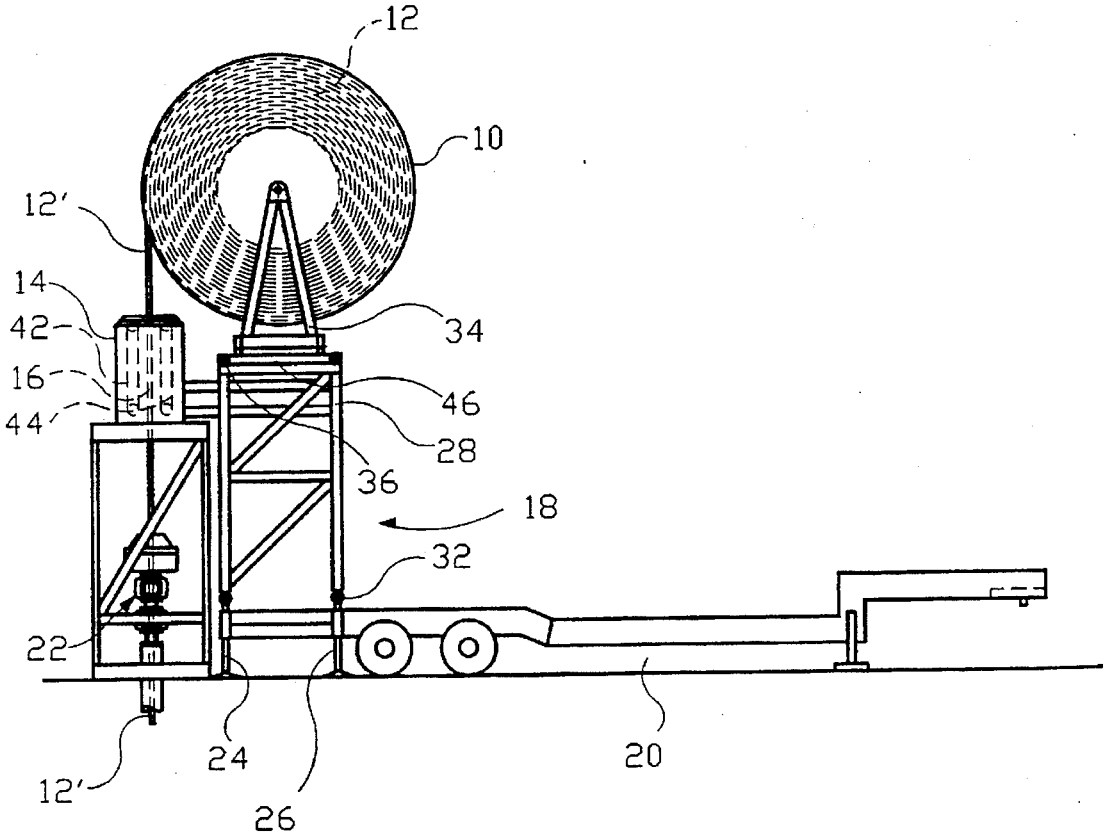
FIG. 2 shows a side elevational view of the same components as in FIG. 1, but here the common rack has been swung about a lower pivot in relation to the blowout preventer, so that the feeding device extends substantially coaxially with the blowout preventer, the vertical longitudinal axis thereof as well as the vertical longitudinal axis of the feeding device extend substantially as being tangents to the circumference of the coil pipe coil, and this course touching the coil circumference is desired to be maintained through the entire uncoiling and coiling operations.
Figure 3:
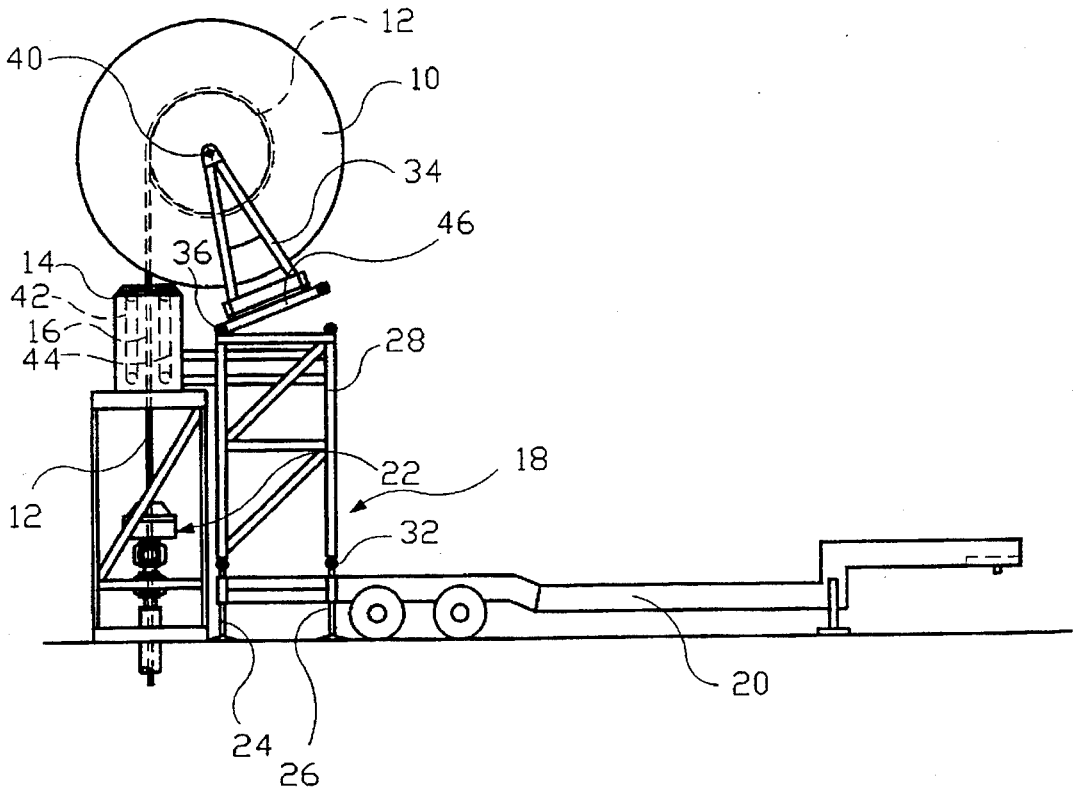
FIG. 3 shows, in the same side elevational view as the preceding figures, how a touching course can be maintained, irrespective of the diameter of the coil pipe coil, and an upper rack part is pivotally disposed on an intermediate rack part about a horizontal axis, in order to allow gradual rotation of the upper rack part carrying the coil pipe drum, adjusted with respect to the diameter of the coil pipe coil.

According to FIG. 2, the outer free end portion 12' of the coil pipe 12 is carried through the vertically through-going passage 16 of the feeding device 14 as well as through the blowout preventer 22 in a linear course, because the feeding device 14 has been positioned coaxially in relation to the blowout preventer 22.

In the embodiment shown, where the coil pipe drum 10 and the feeding device 14 have been mounted on a common rack, such that their mutual positions and orientations are maintained automatically, provisions have been taken to insure that the imaginary continuation of the coil pipe passage 16 represents a tangency in relation to the coil pipe coil coiled up on the drum 10 at the time in question.

In order to maintain the tangent course of the coil pipe passage of the feeding device 14 and of the blowout preventer 22 in relation to the outer circumference of the coil pipe coil, while the coil pipe 12,12' is displaced towards/away from the drum 10 and the outer circumference of the coil pipe coil is being constantly changed, the upper rack 34 of the coil pipe drum 10 is disposed gradually rotatable about a horizontal axis at the articulation 36 between the upper and the intermediate rack part 34 and 28, respectively.

Maintenance of the tangent course prevents the coil pipe in this area from being subjected to undesired bending, possibly followed by straightening. Upon pulling the coil pipe 12 outwards from a drum 10 suspended and positioned in relation to the feeding device 14 in accordance with the present invention, one straightening takes place from a curved course on the drum to a rectilinear course just as the coil pipe leaves the drum 10 tangentially to the outer circumference of the remaining coil pipe coil. During the hauling in operation caused by the feeding device 14, also one strain acting on the coil pipe 12,12' takes place, namely in the form of one bending just as the coil pipe 12,12' is coiled up again on the core 38 of the rotatable drum 10, FIGS. 4 and 5, the rotational axis being denoted with reference numeral 40.

Figure 4:
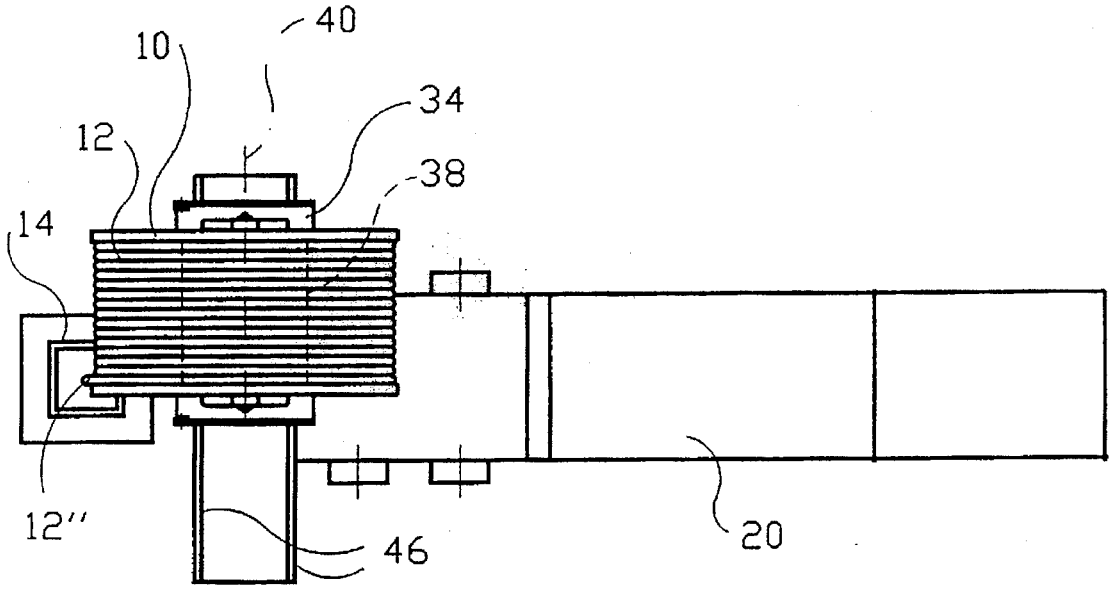
Figure 5:
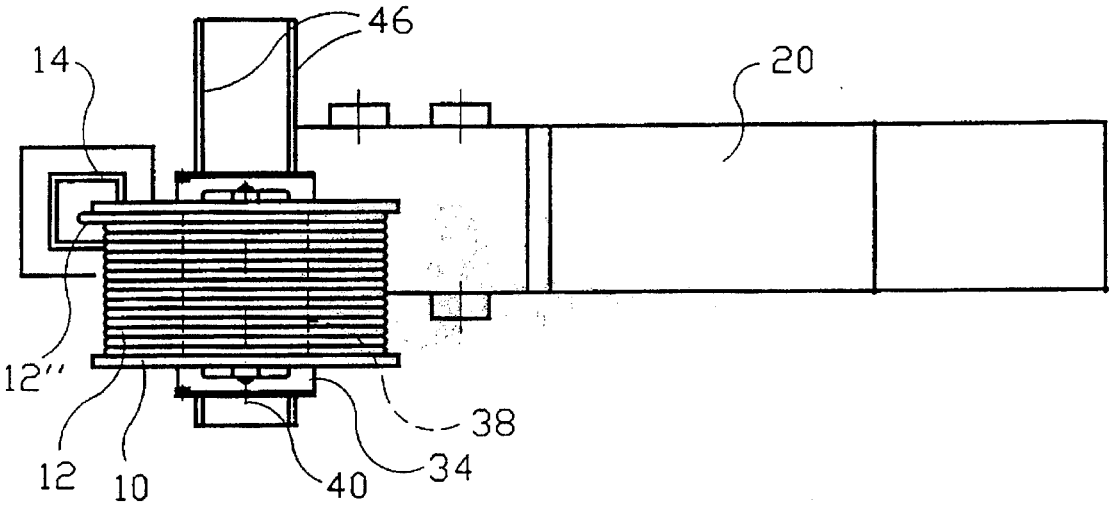

The feeding device 14 adapted to feed out coil pipe from the drum as well as feed in coil pipe towards and onto the drum, is known per se and may be replaced by another embodiment or design. In the embodiment shown the device 14 comprises two opposing, parallel, movable drive means 42, 44 of the endless belt type and having reversible direction of motion, pressing on opposite sides on the coil pipe 12,12' passing through the vertical passage 16 of the device 14. It is, of course, the direction of motion of the belts 42, 44 or the like that determine if the coil pipe 12,12' is moved away from or towards the drum 10. During the displacement thereof in one direction or the other, the coil pipe 12,12' follows a tangential course in relation to the remaining coil pipe's outermost layer of windings but one, providing even coiling up across the length of the core 38 of the drum. Such an even coiling (and consequently uncoiling) of the coil pipe can be achieved without the use of a special coiling device, in accordance with the following:

An intermediate rack part 28 carries uppermost guide rails 46 extending in the rotational axis direction 40 of the drum 10, and on which the upper rack part 34, which is adapted as a slide/carriage, is displaceably disposed to and fro in the longitudinal direction of the guide rails 46, see FIGS. 4 and 5.

The mounting of the coil pipe drum 10 to move to and fro has the same effect that the prior art coiling devices for such coil pipes. Thus, the coil pipe 12,12' is coiled evenly across the length of the drum core 38 and, during uncoiling, the drum 10 moves such on the slide- or carriage-like upper rack part 34 that the free vertical end portion 12' of the outermost coil pipe winding is positioned centrically above the underlying feeding device 14, the same but in reverse order taking place upon the coiling of the coil pipe, the drum 10 moving such in relation to the underlying vertically hanging coil pipe portion fed in towards the drum 10 that the former may extend linearly up to the drum and be wound up thereon next to the last coil pipe winding, on top of the immediately underlying layer of coil pipe windings.

For the sake of clarity, the feeding means 42, 44 of the device 14 have been omitted in FIGS. 4 and 5.

The slide- or carriage-like upper rack part 34 can be displaced in the horizontal plane by means of e.g. hydraulic cylinders (not shown) and, likewise, the upper rack part 34 can be rotated about the articulation 36 by means of e.g. hydraulic cylinders (not shown).

I claim:

1. A method for use in coil pipe operations in which a coil pipe is adapted to be uncoiled from a rotatable drum having a central core and a longitudinal axis, and to be coiled up thereon, the coiling/uncoiling being effected by means of a feeding device, the drum being positioned in association with the feeding device without intermediate guide faces deflecting the directional course of the coil pipe between the drum and the feeding device, the coil pipe on the drum being positioned and aligned such that, in relation to a through-going passage of the feeding device, an imaginary extension of the passage extends substantially tangentially to an outer circumference of the coil pipe on the drum, so that bending/straightening strains acting on the coil pipe between the drum and the feeding device are reduced to one single straightening upon uncoiling of the coil pipe, and one single bending upon coiling of the coil pipe, the method comprising the step of:

gradually pivoting the drum about an axis normal to said imaginary extension during coiling/uncoiling of the coil pipe, in a direction towards the feeding device upon uncoiling of the coil pipe and in a direction away from the feeding device upon coiling of the coil pipe, so that the tangential course of the imaginary extension of the passage in relation to the outer circumference of the coil pipe on the drum is maintained at all times, irrespective of the diameter of the coil pipe circumference at any point in time.

2. A method as set forth in claim 1, further including the step of linearly moving the drum during the coiling/uncoiling of the coil pipe to and fro in the direction of the longitudinal axis of the rotatable drum in order to secure an even distribution of coil pipe windings across the length of the central core of the drum on which the coil pipe is coiled up and from which it is uncoiled.

3. A device for use in coil pipe operations in which a coil pipe having an outer circumference is coiled up on a central core of a rotatable drum having a longitudinal axis and wherefrom it can be uncoiled, the coiling/uncoiling operations being effected by means of a stationary feeding device proximate to the drum and positioned downstream in relation thereto when the coil pipe is being uncoiled and disposed upstream of the drum during coiling of the coil pipe, said device comprising a rack for rotatably receiving the drum to position same opposite the feeding device, the drum and the feeding device being positioned and oriented such that, in relation to each other, an imaginary extension of a through-going passage of the feeding device extends substantially tangentially to the outer circumference of the coil pipe on the drum, and said device further comprising means for pivotally disposing the drum in relation to the feeding device about an axis normal to said imaginary extension to maintain the condition of tangency.

4. A device as set forth in claim 3, further defined as being suitable for mounting on a supporting carriage, said rack being pivotally mountable to the supporting carriage about an axis normal to said imaginary extension for movement between an inoperative position and an operative position.

5. A device as set forth in claim 3, further including means for displacing the drum to and fro in the direction of the longitudinal axis thereof in relation to the feeding device.

* * * * *